US005839733A

United States Patent [19]

Meeks et al.

[11] Patent Number: 5,839,733

[45] Date of Patent: Nov. 24, 1998

[54] PORTABLE GOAL AND METHOD

[76] Inventors: T. Wayne Meeks; Dixie M. Meeks, both of P.O. Box 1115, Seneca, S.C. 29679

[21] Appl. No.: 746,118

[22] Filed: Nov. 6, 1996

[51] Int. Cl.[6] ..... A63B 63/00

[52] U.S. Cl. ..... 273/400; 473/478; 273/407

[58] Field of Search ..... 273/400, 401, 273/402, 407; 473/476, 478

[56] References Cited

U.S. PATENT DOCUMENTS

| | | | |
|---|---|---|---|
| 5,186,469 | 2/1993 | Terris | 473/478 |
| 5,273,292 | 12/1993 | Pardi et al. | 273/400 |
| 5,372,368 | 12/1994 | Pavonetti | 473/478 |
| 5,407,211 | 4/1995 | Bottiglieri | 273/400 |
| 5,431,411 | 7/1995 | Padilla | 273/400 |

FOREIGN PATENT DOCUMENTS

| | | | |
|---|---|---|---|
| 2847701 | 5/1980 | Germany | 273/400 |

*Primary Examiner*—Mark S. Graham
*Attorney, Agent, or Firm*—Ralph Bailey, P.A.

[57] ABSTRACT

A goal and method of assembly and transport for accommodating a playing field to a variety of sports includes a segmented horizontal bar (A) supported in elevated position upon upright legs (B) which are carried in hinged relation and provided with rearwardly extending lower support members (C) Which may be folded upwardly from locked position. The members (B) and (C) may then be folded into side by side alignment with the segmented bar (A) which is then in fully folded position with the rearwardly extending net. Support members may also be folded inwardly for completing the package for towing on the dolly (H). Suitable locking mechanism is provided for securing all of the structural components when fully deployed as a fixed goal upon the playing field. These fixed members may then be released for folding into positioning upon the dolly.

8 Claims, 8 Drawing Sheets

Fig. 9.
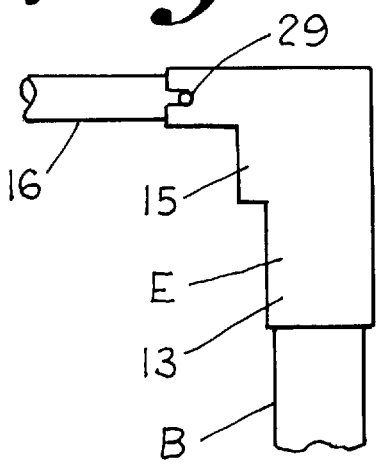
Fig. 8.
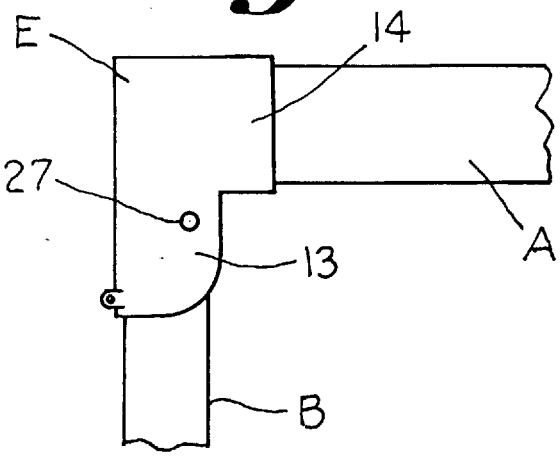
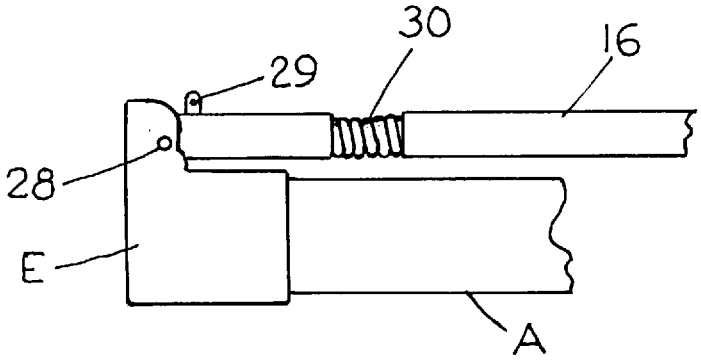
Fig. 10.

PORTABLE GOAL AND METHOD

BACKGROUND OF THE INVENTION

This invention relates to a portable goal and to a method of erecting same such as may be used for soccer, football and the like which may be hinged together for collapsibility and which may be provided with a tow bar and a dolly for transport behind a vehicle to a new location where it is readily assembled.

The problem of providing goal post and auxiliary equipment for the conversion of a playing field for use from one sport to another has been addressed in a number of different ways with only limited success. Goals which may be readily disassembled and transported for easy erection at the same or another site are most desirable.

Portable soccer goals have been provided wherein a separable segmented horizontal bar is provided for use with partially collapsible end pieces for supporting the goal posts upon a soccer field while permitting transport and erection elsewhere. Such soccer goal posts are illustrated in U.S. Pat. Nos. 4,127,272 and 4,407,507. For further example, portable football goals comprising cross bars which may be assembled and disassembled for transport to another playing field elsewhere are illustrated in U.S. Pat. Nos. 3,675,922 and 3,908,922. It would be desirable to provide a goal which could be used for a variety of sports having goal posts which comprises members which are collapsibly hinged together for folding into an assembly wherein the sections are in juxtaposition in aligned side by side relation for transport by pulling behind a vehicle for erection at a different location.

SUMMARY OF THE INVENTION

Accordingly, it is an important object of this invention to provide a versatile goal and method useful for a variety of sports such as soccer, football, portable street hockey and field hockey, a lacrosse goal and the like. The goals are provided with a net where appropriate and the net may be folded together with the hinged components for towing behind a vehicle to a new playing field or for storage.

Another object of the invention is to provide a portable folding goal wherein the components are hinged together so that They may be collapsible and suitable for ready transport by simply folding the members on each other forming aligned components in a single package for carrying on or for towing behind a truck.

Still another important object of the invention is the provision of a versatile goal which with slight adaptations may be useful for a variety of sports wherein the components are collapsible into an aligned package and provided with a horizontal bar on a field of play together with a pair of rearward supports attached to respective legs.

The invention contemplates providing a portable goal utilizing an elongated segmented bar constructed from structural sections which is positioned upon transversely spaced legs carrying the bar in horizontal elevation positioned upon a playing field for carrying suitable accessories such as a net and providing rearwardly support members on the legs wherein the legs may be folded together in side by side relation for transport by a dolly in towing position on the rear of a vehicle.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 8 is an enlarged front elevation further illustrating bracket with hinge for connecting the spaced legs to ends of the top bar;

FIG. 9 is an enlarged end view further illustrating the bracket and hinge of FIG. 8;

FIG. 10 is a top plan view further illustrating the upper supports for a net in folded position and further illustrating the bracket and hinge of FIGS. 8 and 9;

DESCRIPTION OF A PREFERRED EMBODIMENT

Figure 1:
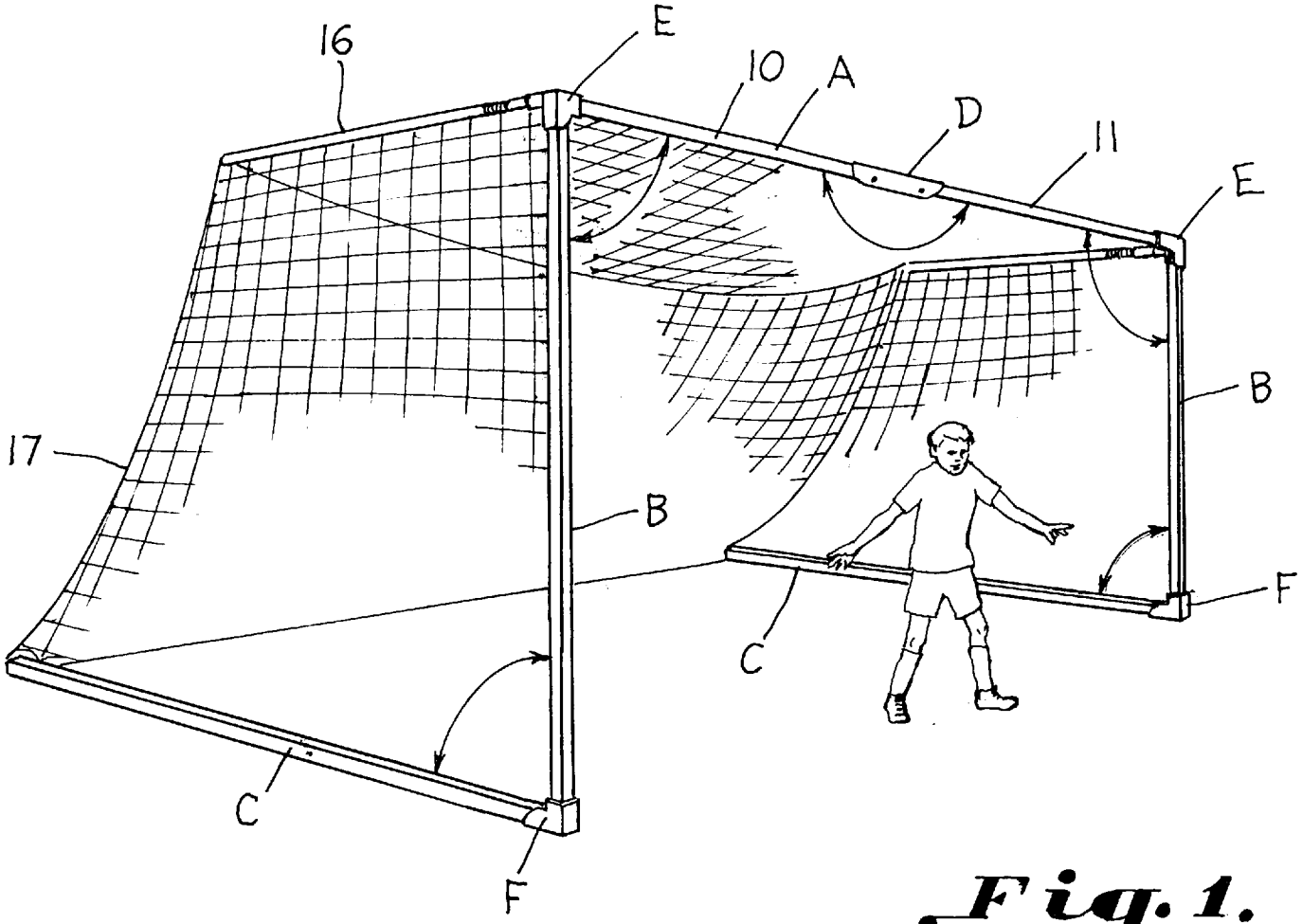
FIG. 1 is a perspective view illustrating a portable soccer goal constructed and in assembled position, including a net, in accordance with the invention on a playing field with folding directions.

A portable goal includes an elongated segmented bar A constructed from a structural section. Legs B are illustrated for supporting the bar in an elevated horizontal position on a playing field with the legs in transversely spaced upright relation thereon and the sections in alignment. A support member C is positioned on a lower end of the legs extending rearwardly therefrom providing a stable base for the goal on the playing field. A central bracket D provides a hinged connection joining sections of the elongated segmented bar in an extended position and with the sections in aligned relation as well as in a position where the sections are in juxtaposition for transport. First and second brackets E and F provide hinged connections joining the legs in spaced relation on the bar and provide a connection joining the support members to a lower end of the legs extending rearwardly therefrom. A tow bar G is attachable to a forward end of the assembly and to a vehicle for transport. Connections are provided securing the segmented bar, the legs and the support members in side by side relation forming an assembly package. A trailer dolly H has two transversely spaced wheels supporting a rear portion of the assembly for transport. Thus, the sections, legs and support members may be secured together in aligned side by side hinged relation for transport on the dolly and thereafter joined on the respective bracket connections for erecting the goal on the playing field.

The elongated segmented bar A is illustrated as including two sections 10 and 11 preferably constructed from square tubular aluminum extruded structural shapes. The upright legs B are also preferably constructed from tubular aluminum members and are received on an upper end within a downwardly opening socket 13 in the huge bracket members E (FIGS. 8 and 9). It will also be observed in FIGS. 6 and 7 that adjacent ends of the sections 10 and 11 are carried within outwardly opening sockets 12 in the intermediate hinged bracket D. Remote ends of the sections 10 and 11 are received within inwardly extending receptacles 14 in the first brackets E and rearwardly extending receptacle 15 is provided in the first brackets E for carrying an upper horizontal net positioning member 16 which extends rearwardly in a horizontal position. The net is draped over the structural members described above and is designated as at 17.

Figure 12:
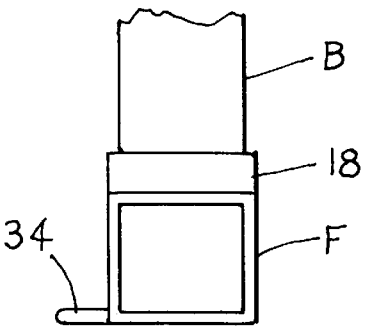
FIG. 12 is a rear elevation further illustrating the bracket shown in FIG. 11.
Figure 11:
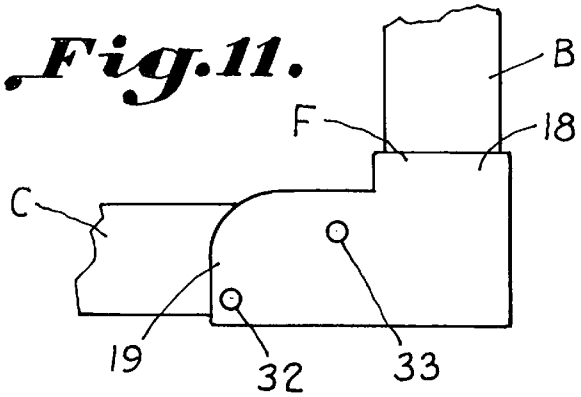
FIG. 11 is a side elevation illustrating a bracket for attachment of a horizontal rearwardly extending support at a lower end of the legs.

The second bracket F receives a lower end of the legs B in an upwardly opening receptacle 18 and a rearwardly extending receptacle 19 receives the horizontal support members C (FIGS. 11 and 12).

Figure 14:
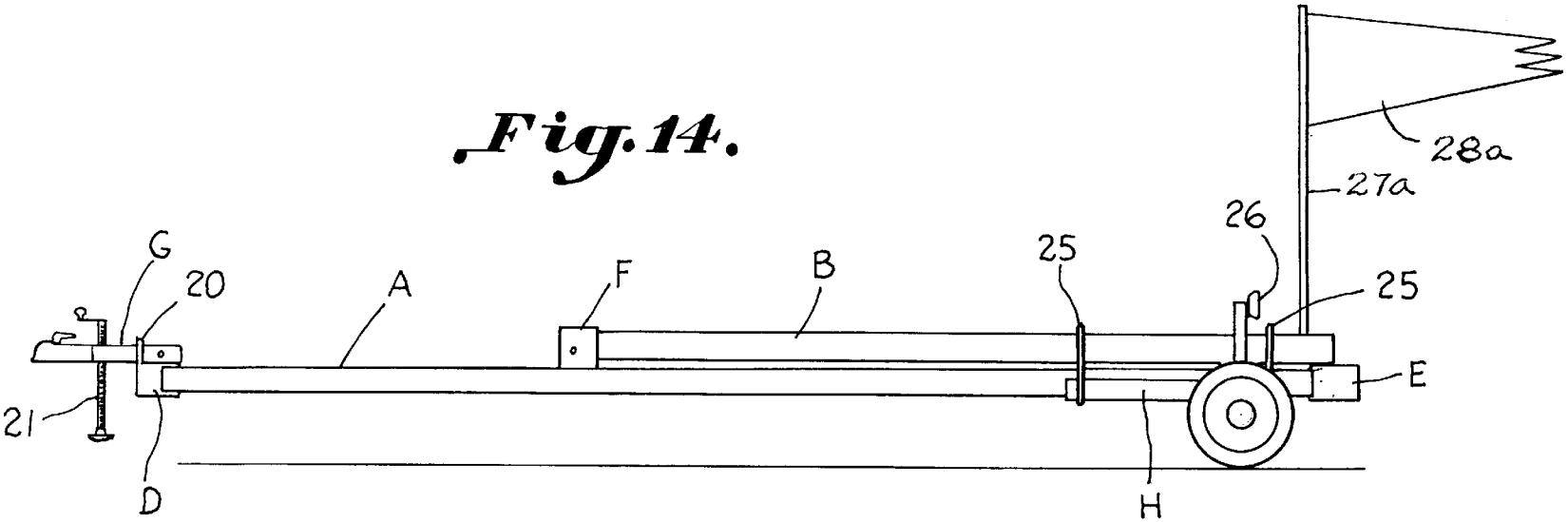
FIG. 14 is a side elevation illustrating an assembly of the structural components packaged and positioned upon a dolly for transport behind a vehicle.
Figure 15:
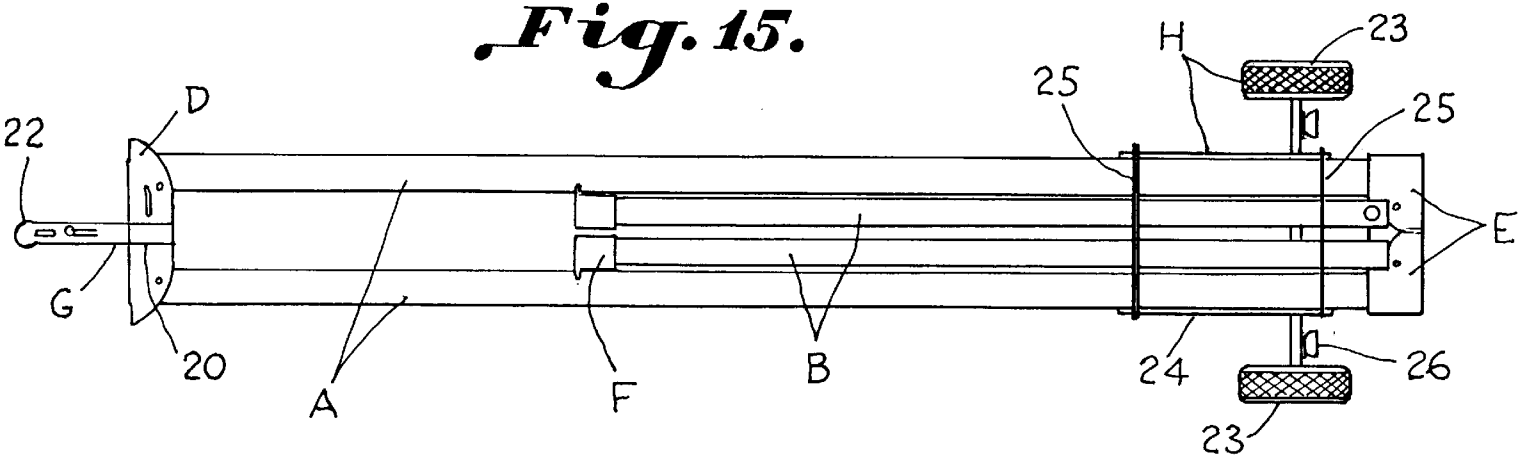
FIG. 15 is a plan view further illustrating the package arranged for transport as illustrated in FIG. 14.

FIGS. 14 and 15 illustrate a tow bar G carried at a forward end of the package formed when the structural sections together with the net are folded together in juxtaposition forming a package to be carried by the dolly H. The tow bar G is carried within a bracket 20 attached to the intermediate or central bracket D. A screw jack is illustrated as at 21 for positioning the dolly with its load in horizontal position prior to attachment of the tow bar to the vehicle.

The tow bar includes a receiver for a ball attachment on the vehicle is illustrated as at 22. The dolly includes opposed wheels 23 and a platform 24 carrying suitable spaced straps 25 for securement of the folded assembly package. Suitable running lights are illustrated at 26. A suitable mast 27*a* is provided for carrying other indicia 28*a* for signaling the end of the assembly package.

Figure 2:
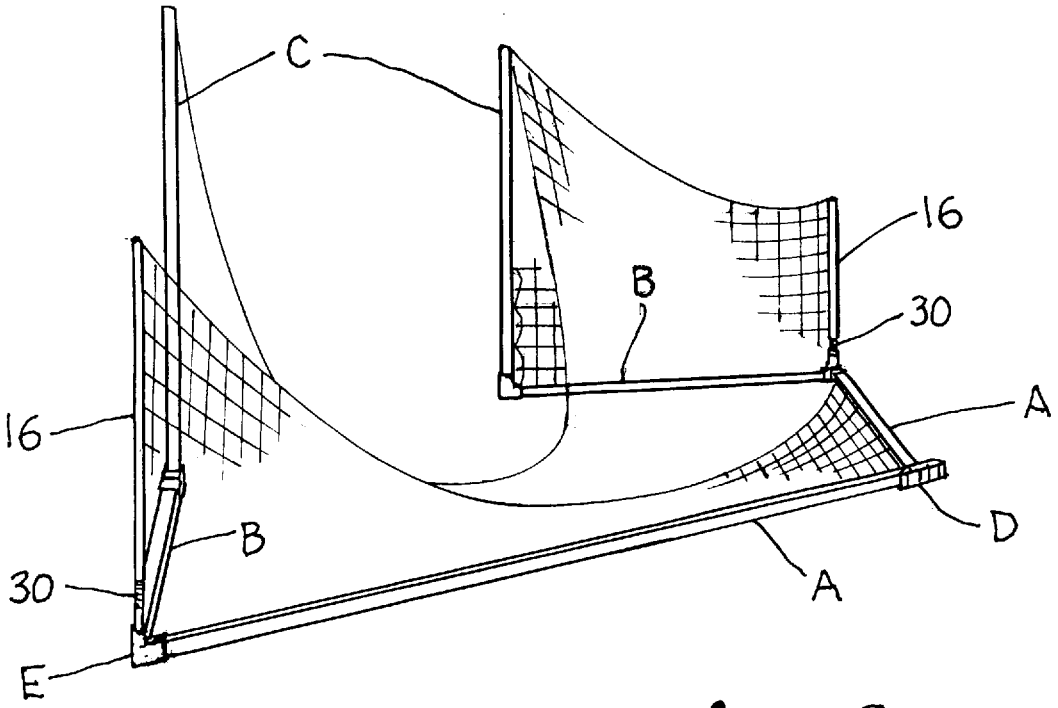
FIG. 2 is a perspective view illustrating the apparatus and method wherein as a first step in disassembly and forming a package for transport the soccer goal is tipped forwardly with a central hinge of the horizontal bar partially folded so that the components are stably supported upon the playing field for completion of the package and loading onto a vehicle for transport.
Figure 7:
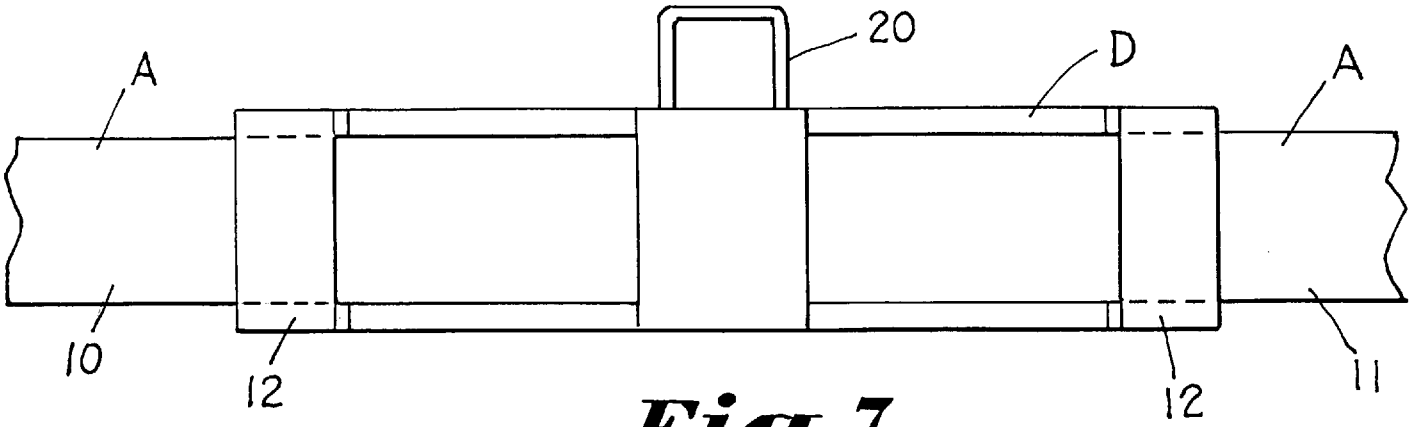
FIG. 7 is a top plan view further illustrating the central hinge with a bracket for attaching a tow bar.
Figure 6:
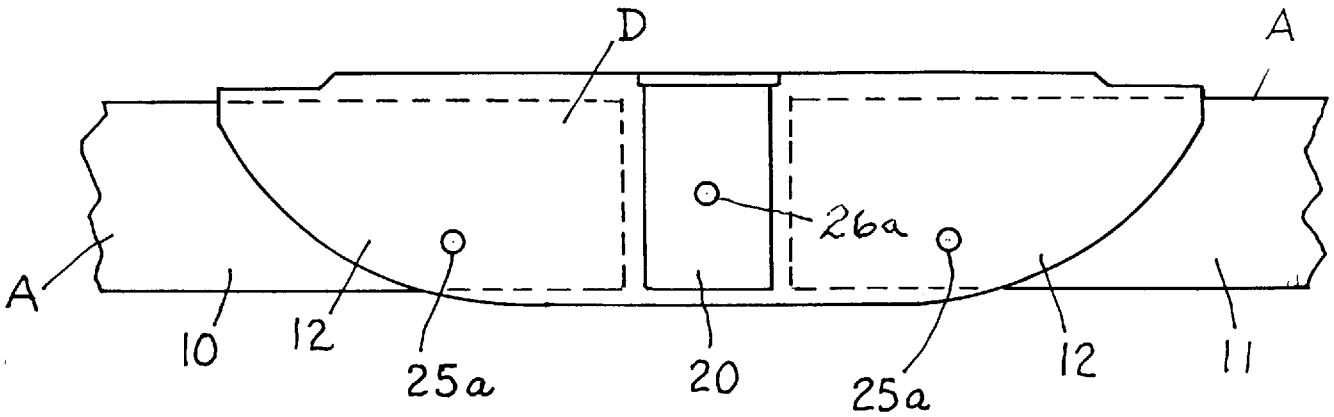
FIG. 6 is a rear view of a central hinge for the top bar.
Figure 13:
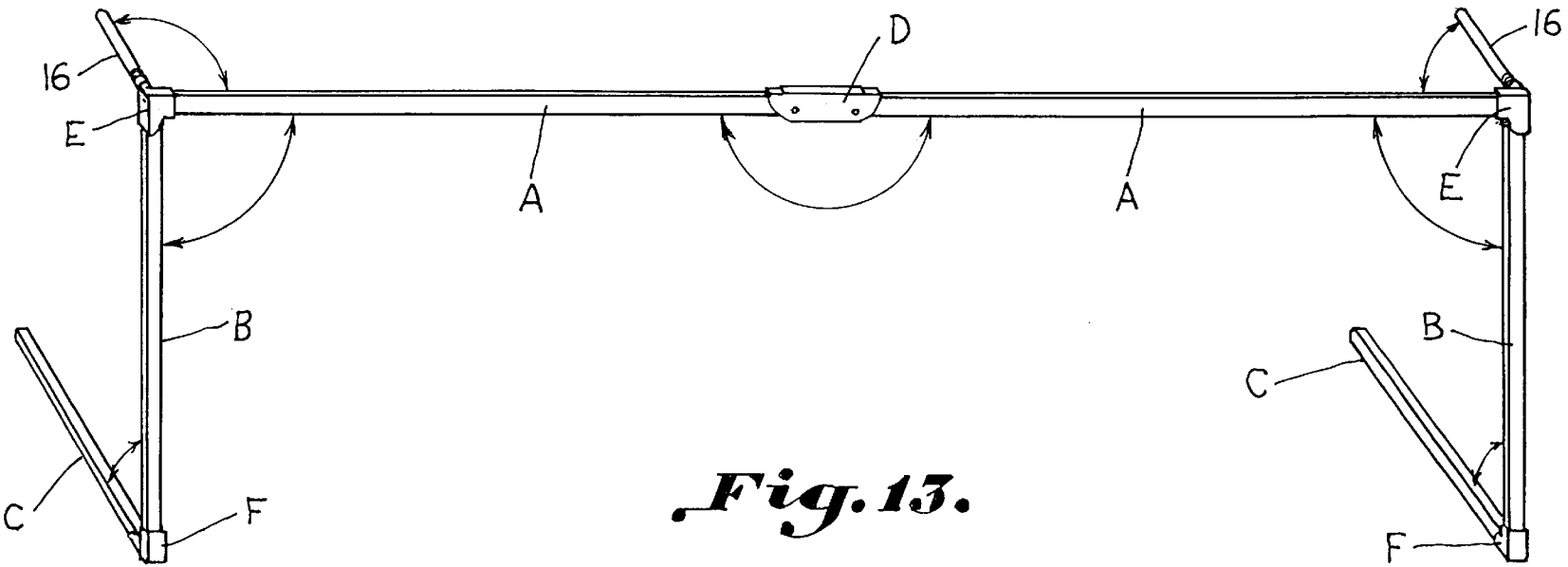
FIG. 13 is a perspective view further illustrating the folding sequences in accordance with the method of the present invention.

Referring more particularly to FIGS. 1 and 2, it will be noted that the first step in forming the assembly package is tipping the goal which is illustrated in this case as a soccer goal forwardly and slightly folding the assembly at the hinge D for stability upon the playing field. The legs C are then folded upwardly against the legs B and the legs B and C are then folded upwardly in FIG. 13 against the segments 10 and 11 of the horizontal bar A. The rearwardly extending net positioning member 16 may then be folded inwardly against the segments of the horizontal bar A as illustrated. The structural members are then in juxtaposition forming a package assembly as illustrated in FIGS. 14 and 15 for transport. The foldable bracket members D, E and F are preferably constructed of aluminum castings. The central or intermediate bracket D is illustrated in FIGS. 6 and 7 as including horizontal pivot pins 25*a* and the centrally disposed bracket 20 for receiving the tow bar G. A suitable opening which may be transverse is illustrated as at 26*a* for receiving a suitable attaching pin for the tow bar. The bracket E is illustrated in FIGS. 8–10 as including suitable hinge or pivot pins 27 and 28 with suitable locking studs 29. The rearwardly extended net positioned members 16 is illustrated as including coil spring members 30 which provide flexibility.

The bottom bracket F at the ends of the legs B includes a hinge pin 32 and a locking pin 33. A suitable locking stud 34 is also provided.

Figure 3:
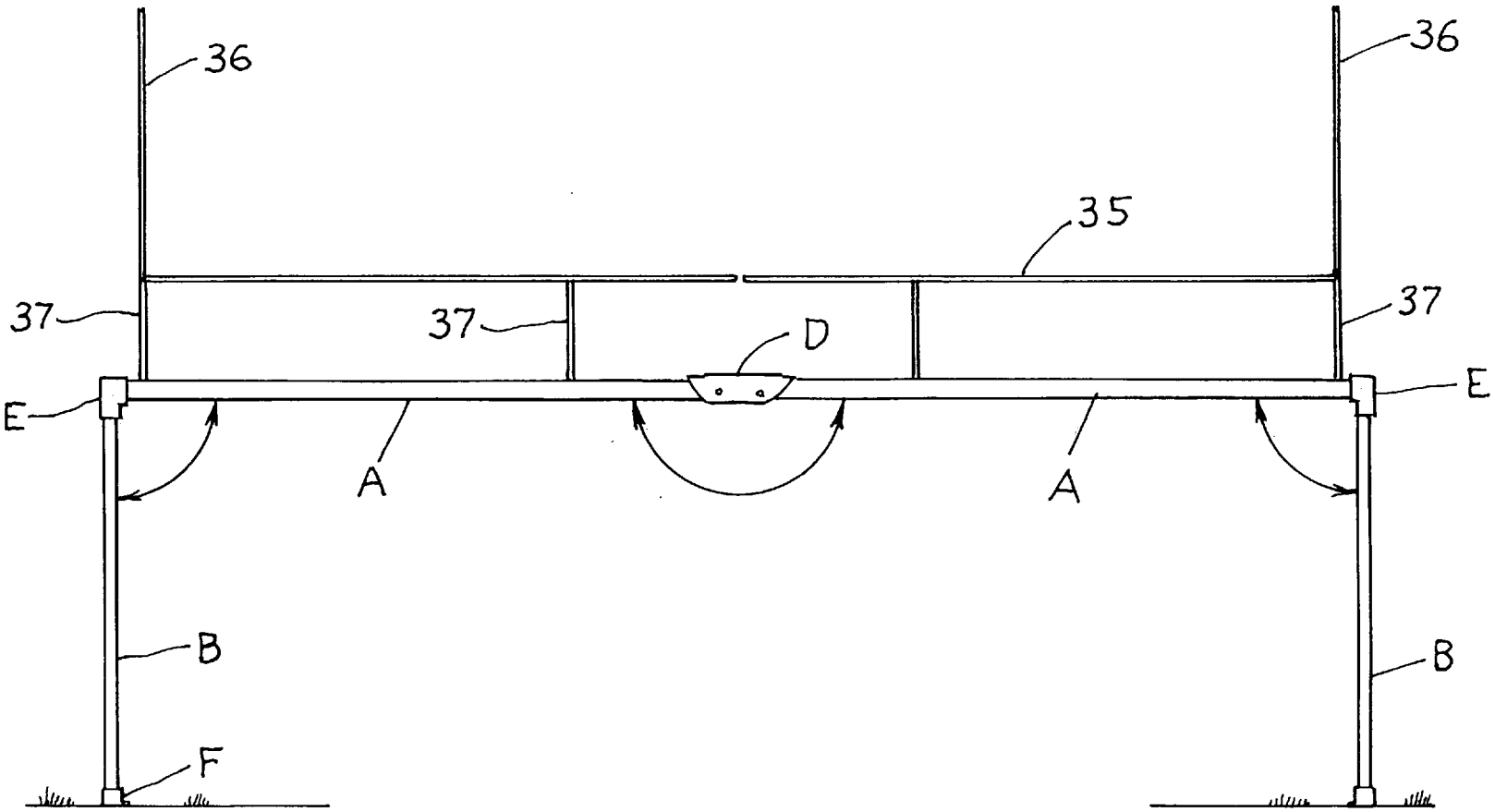
FIG. 3 is a front elevation illustrating the structural components of the soccer goal as illustrated in FIGS. 1 and 2 with an attachment thereto for providing a football goal.
Figure 4:
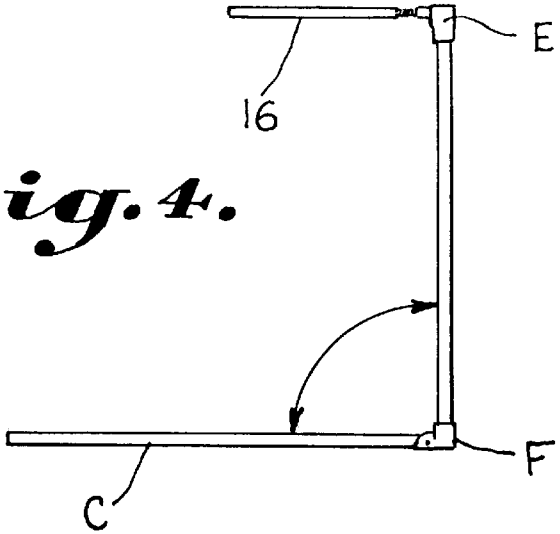
FIG. 4 is an end elevation further illustrating the soccer goal with folding direction.
Figure 5:
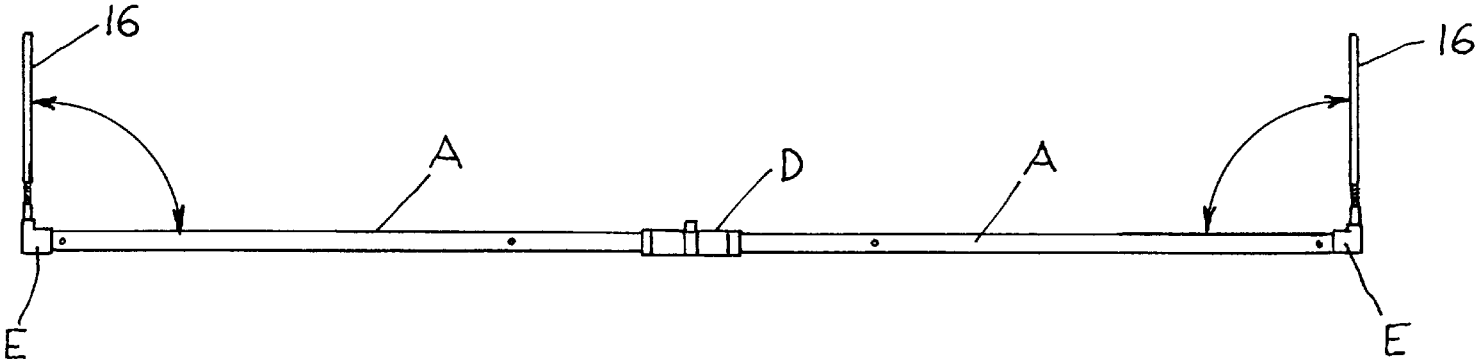
FIG. 5 is a top plan view further illustrating the soccer goal.

While the invention has been described in the context of a soccer goal it is to be understood with slight modifications goals for other games played on a playing field may also be constructed with slight modifications. An optional accessory is illustrated in FIG. 3 as a football goal including segmented cross bar 35 with spaced uprights 36. Suitable vertical members 37 are illustrated for securement of the football goal above the bar A which would otherwise be a soccer goal in FIG. 3.

While a preferred embodiment of the invention has been described using specific terms, such description is for illustrative purposes only, and it is to be understood that changes and variations may be made without departing from the spirit or scope of the following claims.

What is claimed is:

1. A portable goal comprising:

an elongated bar made from a structural section;

legs for supporting the bar in an elevated horizontal position on a playing field with the legs in transversely spaced upright relation thereon;

a support member for positioning on a lower end of each of the legs extending rearwardly therefrom providing a stable base for the goal on the playing field;

a first bracket for providing a hinged connection joining each of said legs in spaced relation on the bar including a horizontal connection joining an end of the bar;

a vertical connection integral with said horizontal connection extending downwardly joining a leg; and a horizontal pin in said vertical connection about which said legs are folded inwardly against said horizontal bar;

a second bracket for providing a hinged connection for joining the support members to a lower end of said legs extending rearwardly therefrom including a vertical connection joining a lower end of said leg;

a horizontal connection integral with the vertical connection extending rearwardly joining said horizontal support member; and a horizontal pin in said horizontal connection about which said horizontal support members are folded upwardly against respective legs;

whereby said legs and support members may be joined together in aligned side by side relation for transport and thereafter folded on the respective hinged connections for erecting the goal on a playing field.

2. The portable goal set forth in claim 1 wherein a soccer goal is constructed utilizing a central bracket hingedly connecting sections forming the elongated bar.

3. The portable goal set forth in claim 1 including an upper net supporting member extending rearwardly from said first bracket.

4. The portable goal forth in claim 3 including a coil spring forming an intermediate portion of said upper member for providing flexibility.

5. The portable goal set forth in claim 1 further including a football post and cross bar mounted upon the horizontal bar.

6. The portable goal set forth in claim 1 including a wheeled member carrying said legs and support members in aligned side by side relation for transport.

7. The portable goal set forth in claim 6 including an attachment means for fastening the wheeled members carrying said legs and support member to a vehicle for transport.

8. A method for erecting a portable goal comprising the steps of:

providing an elongated segmented bar constructed from structural sections;

hingedly connecting legs for supporting said bar in an elevated horizontal position on a playing field with the legs in transversely spaced upright relation thereon and the sections in aligned relation;

hinging a support member on a lower end of said legs extending rearwardly therefrom providing a stable base for the goal on the playing field;

joining said sections utilizing an intermediate bracket for providing a hinged connection between said sections of said elongated segmented bar in an extended position with said sections in aligned relation;

folding said sections to a position where said sections are in juxtaposition forming an assembly for transport; and utilizing first and second hinged brackets for providing connections joining said legs in spaced relation on said bar and for providing a connection joining the support members to a lower end of said legs extending rearwardly therefrom;

attaching a tow bar to a front end of the assembly and to a vehicle for transport;

folding pivotal connections securing said segmented bar, said legs and said support member in side by side relation forming an assembly; and positioning a trailer dolly having two spaced wheels supporting a rear portion of the assembly for transport;

whereby said sections, legs and support members may be secured together in aligned side by side relation for transport on the dolly and thereafter joined or the respective bracket connections for erecting the goal on a playing field.

* * * * *